US011011881B1

(12) United States Patent
Chien et al.

(10) Patent No.: US 11,011,881 B1
(45) Date of Patent: May 18, 2021

(54) INTERCHANGEABLE PLUG CHARGER WITH COAXIAL CONDUCTIVE STRUCTURE

(71) Applicant: Salcomp (Shenzhen) Co., Ltd., Shenzhen (CN)

(72) Inventors: Hsu-Pin Chien, Taipei (TW); Chien-Chung Wu, Taipei (TW)

(73) Assignee: SALCOMP (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 16/906,431

(22) Filed: Jun. 19, 2020

(30) Foreign Application Priority Data

May 22, 2020 (TW) ..... 109117072

(51) Int. Cl.

| | |
|---|---|
| ***H01R 39/00*** | (2006.01) |
| ***H01R 31/06*** | (2006.01) |
| ***H01R 13/625*** | (2006.01) |
| ***H01R 13/66*** | (2006.01) |

(52) U.S. Cl.
CPC ..... *H01R 31/065* (2013.01); *H01R 13/625* (2013.01); *H01R 13/6675* (2013.01)

(58) Field of Classification Search
CPC ..... H01R 39/64; H01R 39/00; H01R 35/04; H01R 13/652
USPC ..... 439/21, 20–28, 11, 13, 106
See application file for complete search history.

(56) References Cited

U.S. PATENT DOCUMENTS

| | | | | | |
|---|---|---|---|---|---|
| 2,425,679 | A * | 8/1947 | Jackson | H01R 13/502 | 439/680 |
| 2,542,935 | A * | 2/1951 | McElroy | H01R 39/00 | 439/27 |
| 2,570,784 | A * | 10/1951 | Ferguson | H01R 39/00 | 439/27 |
| 2,654,869 | A * | 10/1953 | Mudd, Jr. | H01R 39/64 | 439/27 |
| 2,898,572 | A * | 8/1959 | Shinn | H01R 39/00 | 439/22 |
| 3,335,395 | A * | 8/1967 | Smith | H01R 13/56 | 439/466 |
| 5,114,352 | A * | 5/1992 | Gahagen | H01R 39/64 | 439/22 |

(Continued)

*Primary Examiner* — Phuong Chi Thi Nguyen
(74) *Attorney, Agent, or Firm* — Chun-Ming Shih; HDLS IPR Services

(57) ABSTRACT

An interchangeable plug charger with a coaxial conductive structure includes a charger body and a plug assembly. The charger body has a retaining surface inside, and the retaining surface has a first conductive terminal and a second conductive terminal. The plug assembly is detachably connected to the charger body and includes a plug socket and the coaxial conductive structure. The coaxial conductive structure includes a hollow insulating column, a first conductively connected component sheathed on the hollow insulating column, and a second conductively connected component connected to the interior of the hollow insulating column. The first conductively connected component is electrically connected to the first conductive terminal, and the second conductively connected component is electrically connected to the second conductive terminal. Therefore, the size of the charger can be reduced and the structure of the charger can be simplified to improve the convenience of carrying and use.

11 Claims, 10 Drawing Sheets

(56) References Cited

U.S. PATENT DOCUMENTS 10,186,792 B2 * 1/2019 Riesgaard ..... H01R 31/06

* cited by examiner

INTERCHANGEABLE PLUG CHARGER WITH COAXIAL CONDUCTIVE STRUCTURE

BACKGROUND OF THE INVENTION

1. Technical Field

The technical field of this disclosure relates to chargers, and more particularly to an interchangeable plug charger with a coaxial conductive structure.

2. Description of Related Art

Charger is a device for converting alternating current (AC) into direct current (DC) and then transmitting the current to electronic devices including PDAs, mobile phones, electronic books and tablet PCs for their charging and operation. Among different types of chargers, the interchangeable plug charger provides different configurations of pins to improve the convenience of use and gradually becomes a popular product.

In general, a conventional interchangeable plug charger comprises a charger body and a plug assembly, and the plug assembly is coupled to the charger body, and the charger body comprises two conductive terminals separated from each other, and the plug assembly comprises two conductively connected rods separated from each other, and each conductively connected rod is electrically coupled to each respective conductive terminal.

However, the conventional interchangeable plug charger has each conductive terminal and each conductively connected rod separated from each other, so that the size (or the total volume) of both charger body and plug assembly cannot be minimized for the design and manufacture of the charger. As a result, the charger is inconvenient to carry or store.

In view of the aforementioned drawbacks of the prior art, the discloser of the present disclosure based on years of experience in the related industry to conduct extensive research and experiment, and finally provided a feasible solution by combining two conductively connected rods into one to overcome the drawbacks of the conventional charger.

SUMMARY OF THE INVENTION

Therefore, it is a primary object of this disclosure to provide an interchangeable plug charger with a coaxial conductive structure, and the design of the coaxial conductive structure significantly reduces the size or total volume of the charger to improve the convenience of carrying and use.

To achieve the aforementioned and other objectives, the present disclosure discloses an interchangeable plug charger with a coaxial conductive structure comprising a charger body and a plug assembly, and the charger body has a retaining surface, and the retaining surface has a first conductive terminal and a second conductive terminal, and the plug assembly is detachably coupled to the charger body, and the plug assembly comprises a plug socket and a coaxial conductive structure passed and coupled to the plug socket, and the coaxial conductive structure comprises a hollow insulating column sheathed on a first conductively connected component outside the hollow insulating column and passed and coupled to a second conductively connected component inside the hollow insulating column, and the first conductively connected component is electrically coupled to the first conductive terminal, and the second conductively connected component is electrically coupled to the second conductive terminal.

The present disclosure has the following advantages: The insulating cover and the female terminal block jointly cover the first conductive terminal and the second conductive terminal to prevent the arcing of voltage and current, so as to improve the safety of use. In addition, the integration of each conductively connected component with the hollow insulating column simplifies the whole structure of the charger.

DESCRIPTION OF THE PREFERRED EMBODIMENTS

Figure 1:
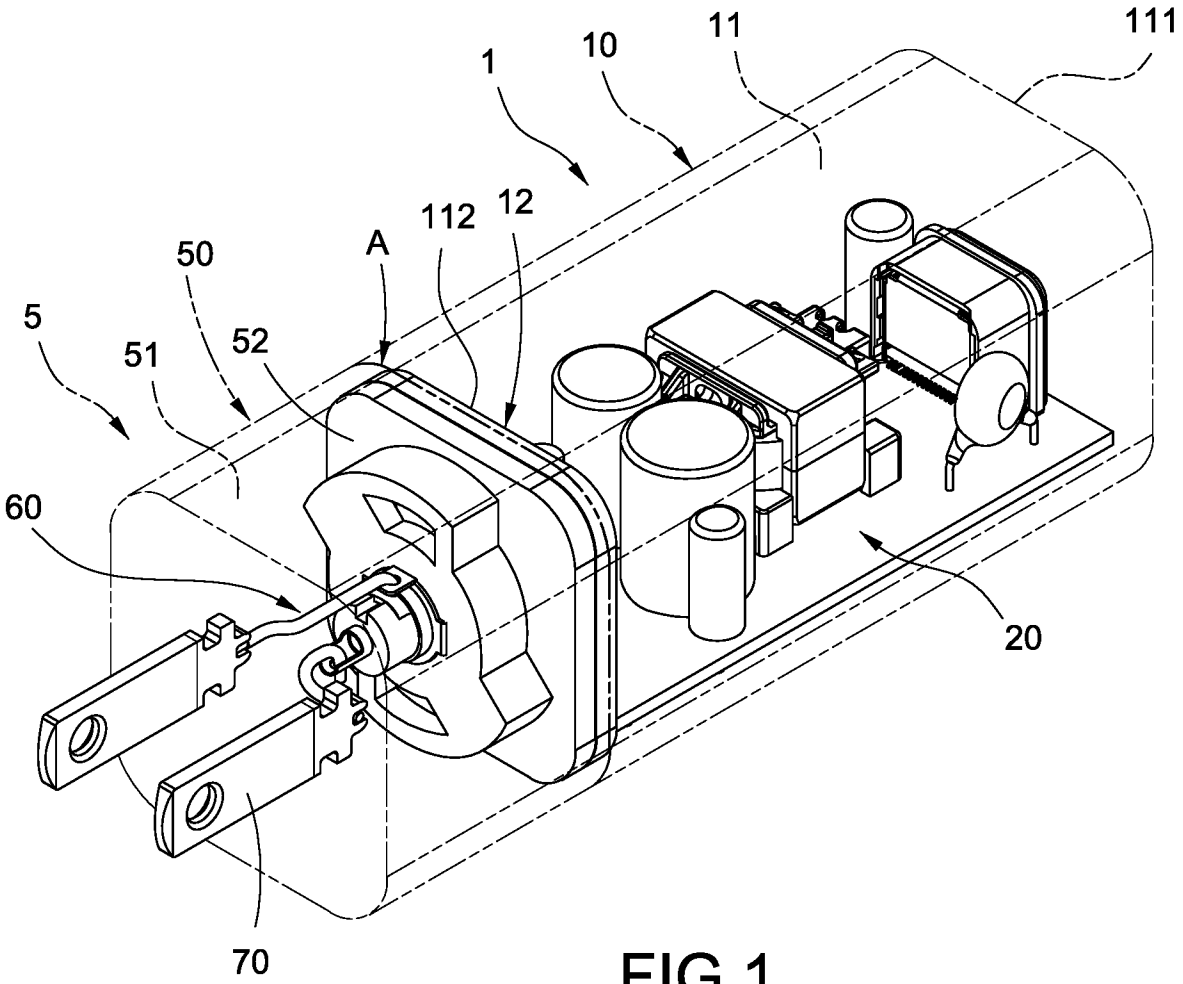
FIG. 1 is a perspective view of a first embodiment of the present disclosure.
Figure 2:
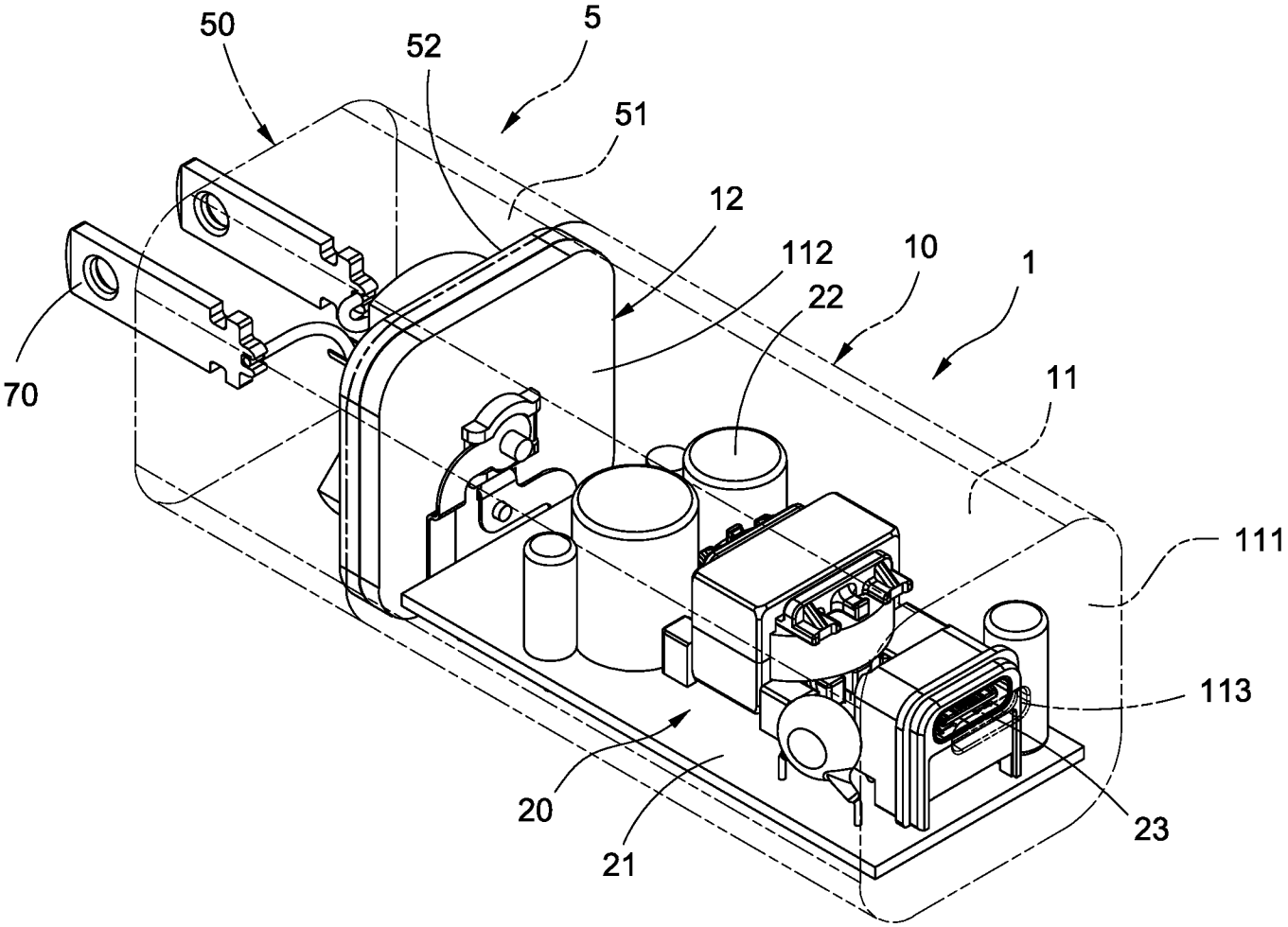
FIG. 2 is another perspective view of the first embodiment of the present disclosure as depicted in FIG. 1 (viewing from another angle)

The technical contents of this disclosure will become apparent with the detailed description of preferred embodiments accompanied with the illustration of related drawings as follows. It is intended that the embodiments and drawings disclosed herein are to be considered illustrative rather than restrictive.

With reference to FIGS. 1 to 6 for an interchangeable plug charger with a coaxial conductive structure of the present disclosure, the interchangeable plug charger comprises a charger body 1 and a plug assembly 5.

The charger body 1 comprises a casing 10, a power supply module 20, a first conductive terminal 30 and a second conductive terminal 40, and the casing 10 comprises a cylinder 11 and a side cover 12, and the cylinder 11 of this embodiment is in a rectangular shape, but this disclosure is not limited to such arrangement only. The cylinder 11 has a closed end 111 and an open end 112, and the closed end 111 has a slot opening 113. The side cover 12 corresponding to the open end 112 seals and covers an end of the cylinder 11 to form a retaining surface A of the casing 11.

Figure 3:
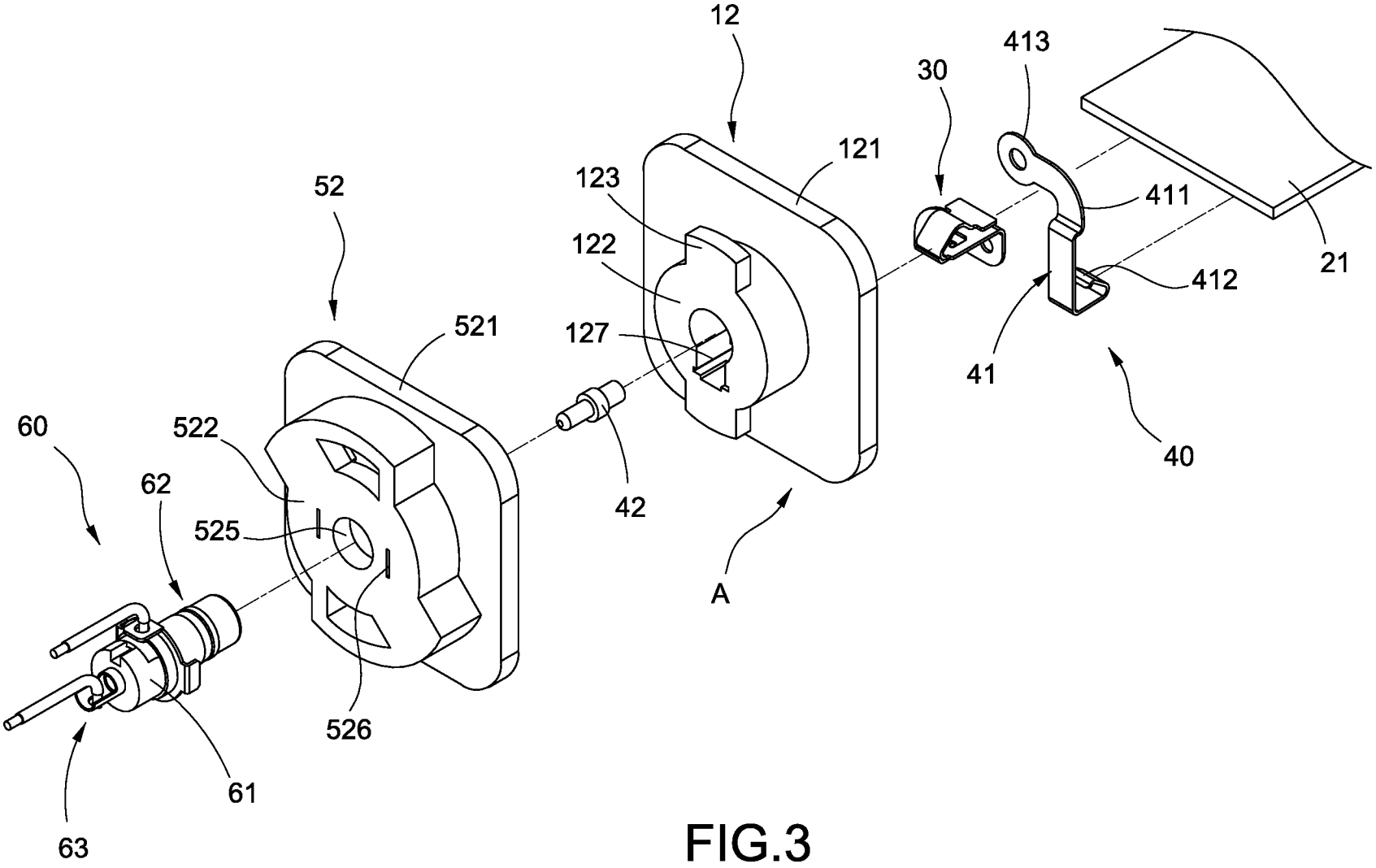
FIG. 3 is an exploded view showing some parts of the present disclosure.
Figure 4:
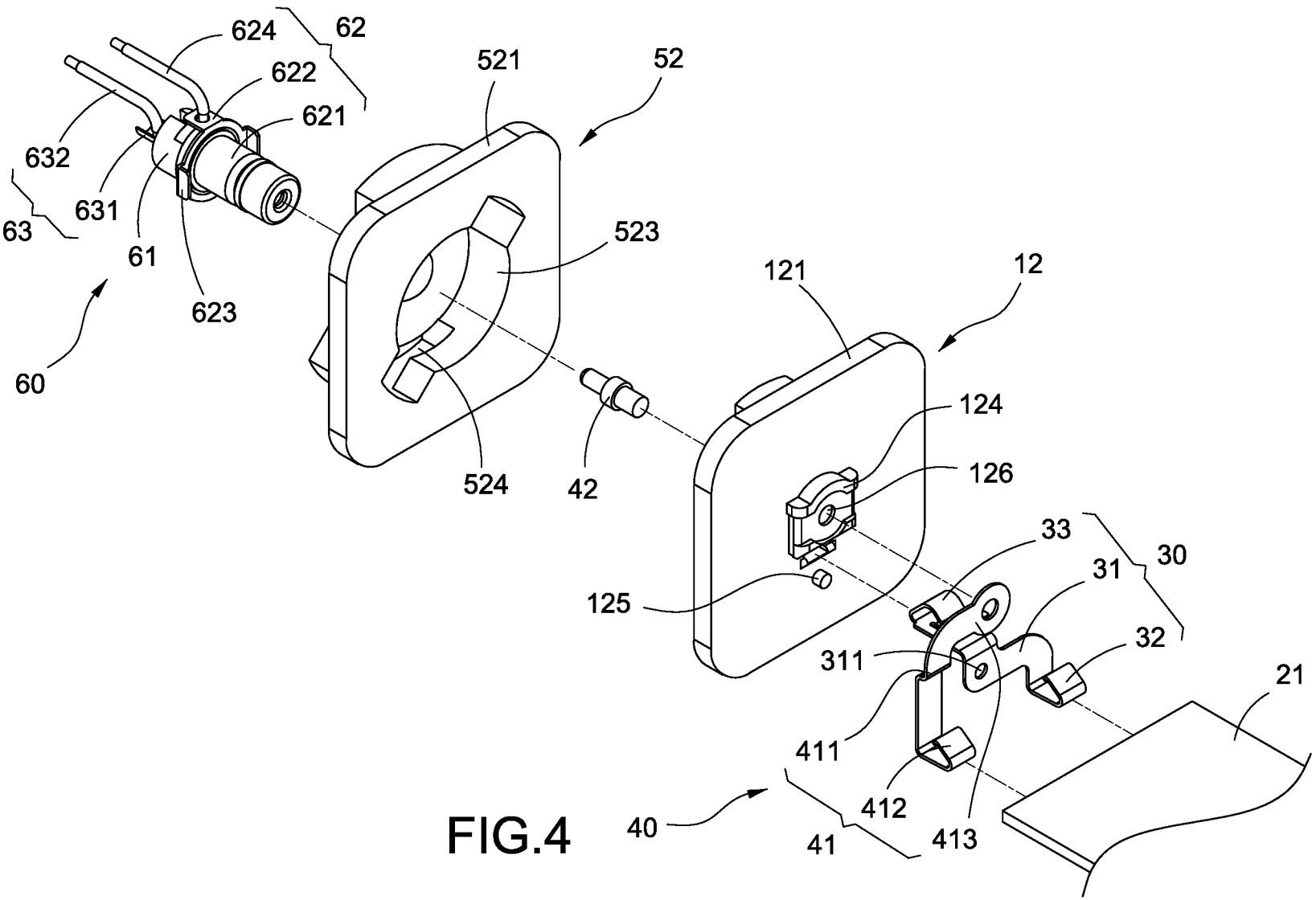
FIG. 4 is another exploded view showing some parts of the present disclosure as depicted in FIG. 3 (viewing from another angle)

The side cover 12 comprises a base plate 121, a boss 122 extending outwardly from the base plate 121, and a pair of hooks 123 formed at an end of the boss 122 away from the base plate 121. In addition, a terminal fixing table 124 and a positioning column 125 extend from an end of the base plate 121 facing the back of the boss 122, and a through hole 126 is formed at the center of the terminal fixing table 124, and a terminal receiving slot 127 (as shown in FIG. 3) is formed between the back of the terminal fixing table 124 and the positioning column 125 and at the top of the positioning column 125.

The power supply module 20 is accommodated in the cylinder 11 and comprises a circuit board 21, and a plurality of electronic components 22 installed on the circuit board 21, and the electronic components 22 are related components such as capacitors, resistors, inductors, and windings. The circuit board 21 has a port 23 formed at a position near the closed end 111, and the port 23 can be a Micro USB connector or a Type C connector, which is configured to be corresponsive to the slot opening 113.

The first conductive terminal 30 is made of a good electrically conductive material such as copper or its alloys, and the first conductive terminal 30 comprises a fixed section 31, an abutment section 32 extending outwardly from the fixed section 31, and a conductively connecting section 33 extending from the fixed section 31 in a direction away from the abutment section 32, and the fixed section 31 has a positioning hole 311, and the first conductive terminal 30 is sheathed on the positioning column 125 by using the positioning hole 311, and the conductively connecting section 33 is passed through the terminal receiving slot 127 and fixed onto the base plate 121, and the abutment section 32 is electrically coupled to the circuit board 21.

The second conductive terminal 40 comprises a conductive terminal 41 and a conductive column 42, wherein the conductive terminal 41 and the conductive column 42 are made of a good conductive material such as copper and its alloys, and the conductive terminal 41 comprises a fixed section 411, an abutment section 412 extending outwardly from the fixed section 411 and a conductively connecting section 413 extending from the fixed section 411 in a direction away from the abutment section 412, and the fixed section 411 is attached onto a side of the terminal fixing table 124, and the conductively connecting section 413 is affixed onto the terminal fixing table 124, and the conductive column 42 has an end passed through the through hole 126 and coupled to the conductively connecting section 413 and the other end fixed into the terminal receiving slot 127 by an assembling or formation process, and the abutment section 412 is electrically coupled to the circuit board 21.

The plug assembly 5 is detachably coupled to the charger body 1 and comprises a plug socket 50, a coaxial conductive structure 60 and two pins 70, and the plug socket 50 comprises a shell 51 and an end cover 52, and the end cover 52 is engaged and sealed with an end of the shell 51 by ultrasonic welding, wherein the shell 51 is in a rectangular shape, but this disclosure is not limited to this shape only, and the other end of the shell 5 away from the end cover 52 is provided for inserting and fixing each pin 70.

The end cover 52 comprises a cover plate 521, a boss 522 extending outwardly from the cover plate 521, a boss receiving slot 523 formed at an end of the boss 522 proximate to the cover plate 521, and a pair of embedded slots 524 formed at a root portion of the boss receiving slot 523, wherein the boss receiving slot 523 is provided for embedding and installing the boss 122, and the embedded slot 524 is provided for rotatably latching each hook 123. In addition, a shaft hole 525 is formed at the middle of the boss 522, and two positioning notches 526 are formed at the outer periphery of the shaft hole 525.

Figure 5:
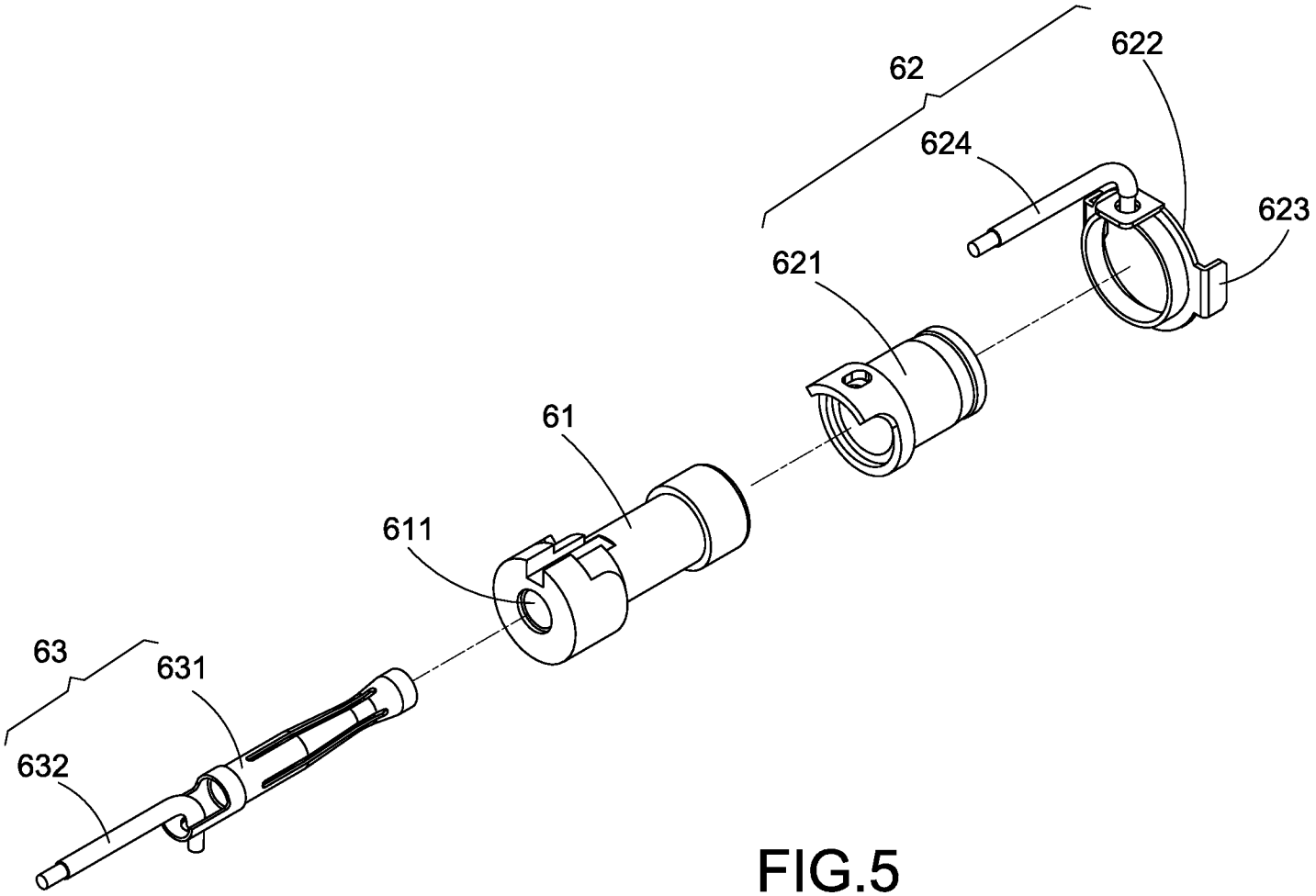
FIG. 5 is an exploded view of a coaxial conductive structure of the present disclosure.
Figure 6:
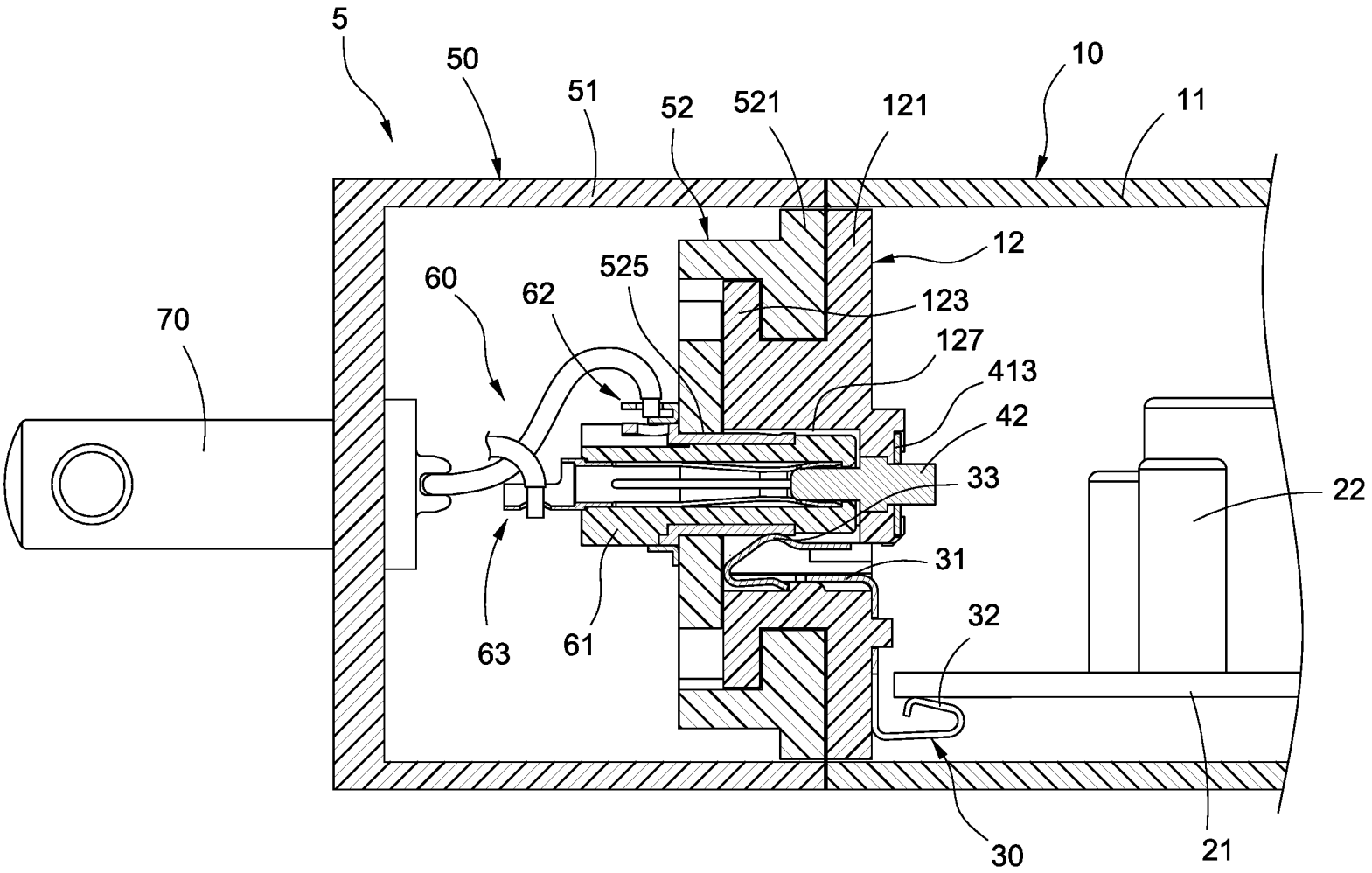
FIG. 6 is a cross-sectional view of an interchangeable plug charger of the present disclosure.
Figure 7:
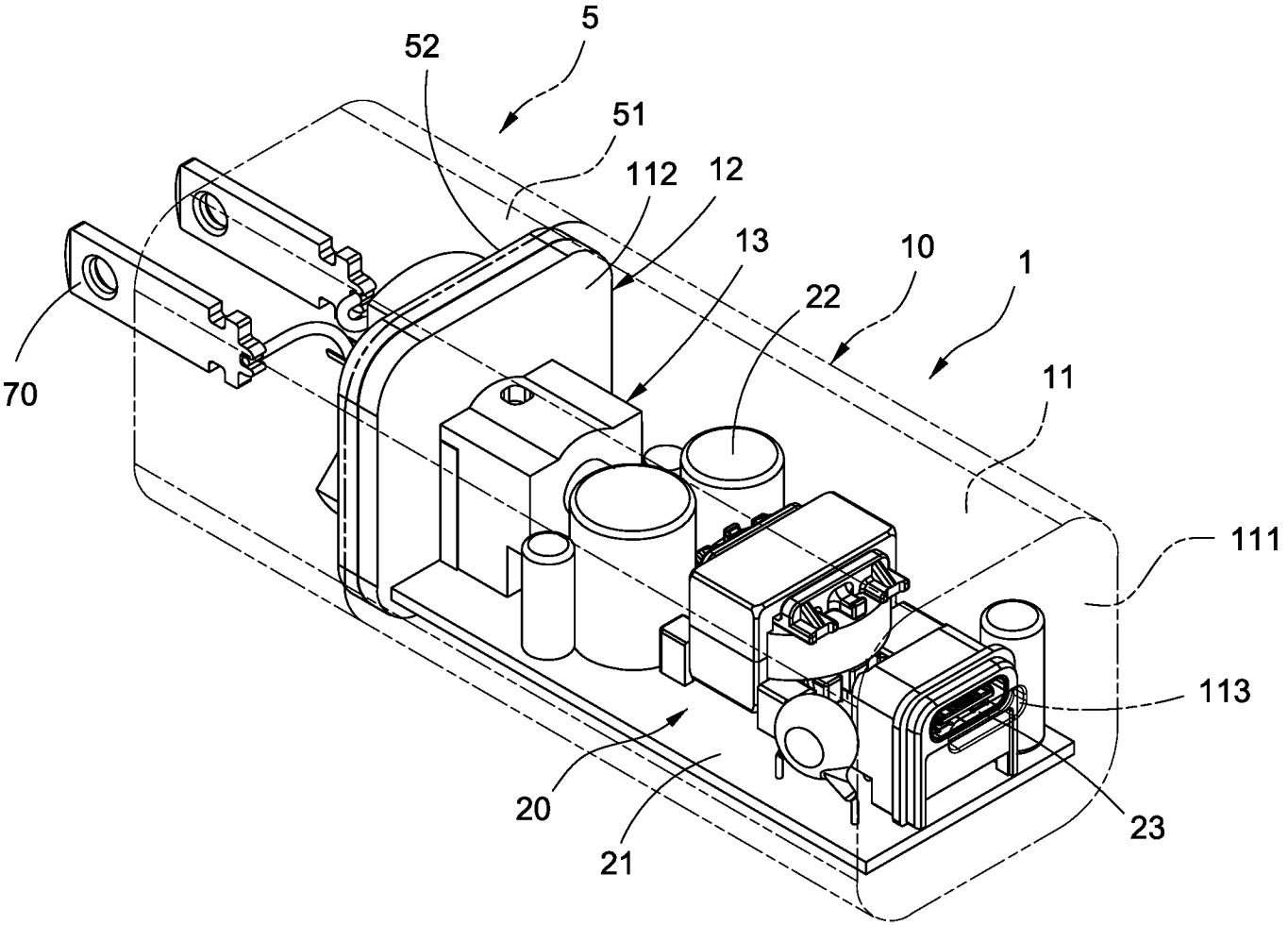
FIG. 7 is a perspective view of a second embodiment of the present disclosure.

In FIG. 5, the coaxial conductive structure 60 and the plug socket 50 are manufactured by an embedding injection or assembling process, and the coaxial conductive structure 60 is passed and connected to the shaft hole 525 of the plug socket 50, and the coaxial conductive structure 60 comprises a hollow insulating column 61, a first conductively connected component 62 and a second conductively connected component 63, wherein the hollow insulating column 61 is made of a good insulation material such as plastic, and has a terminal receiving hole 611, wherein the length of the hollow insulating column 61 is 23 mm, and the internal diameter of the terminal receiving hole 611 is 1.6 mm, and the maximum external diameter of the hollow insulating column 61 is 5 mm.

The first conductively connected component 62 comprises an outer copper bushing 621 and a conductive ring 622, and the outer copper bushing 621 is made of a nickel-plated copper material and sheathed on the hollow insulating column 61 and fixed to a position, and the conductive ring 622 is sheathed on the outer copper bushing 621 and has a positioning plate 623 embedded into each respective positioning notch 526. In this embodiment, the first conductively connected component 62 further comprises a conductively connected wire 624 with an end electrically coupled to the conductive ring 622 and the other end electrically coupled to one of the pins 70.

The second conductively connected component 63 comprises an inner copper bushing 631 made of a phosphor bronze material and sheathed on the terminal receiving hole 611 of the hollow insulating column 61, and an end of the inner copper bushing 63 is provided for passing the conductive column 42 of the second conductive terminal 40 and electrically coupled to the conductive column 42 of the second conductive terminal 40. In this embodiment, the second conductively connected component 63 further comprises a conductively connected wire 632 with an end electrically coupled to the inner copper bushing 631 and the other end electrically coupled to the other pin 70.

Figure 8:
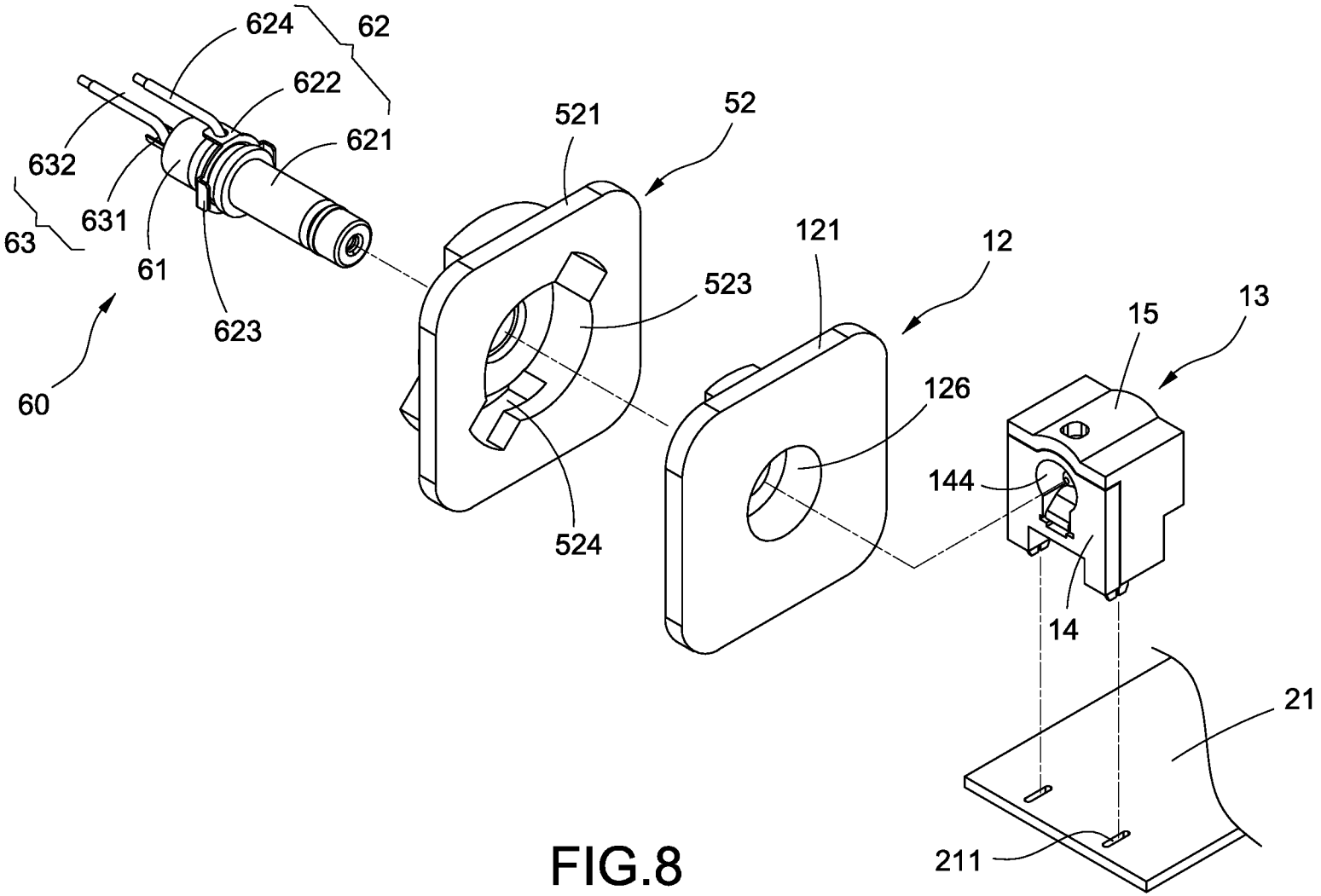
FIG. 8 is an exploded view showing some parts of the present disclosure as depicted in FIG. 7.
Figure 9:
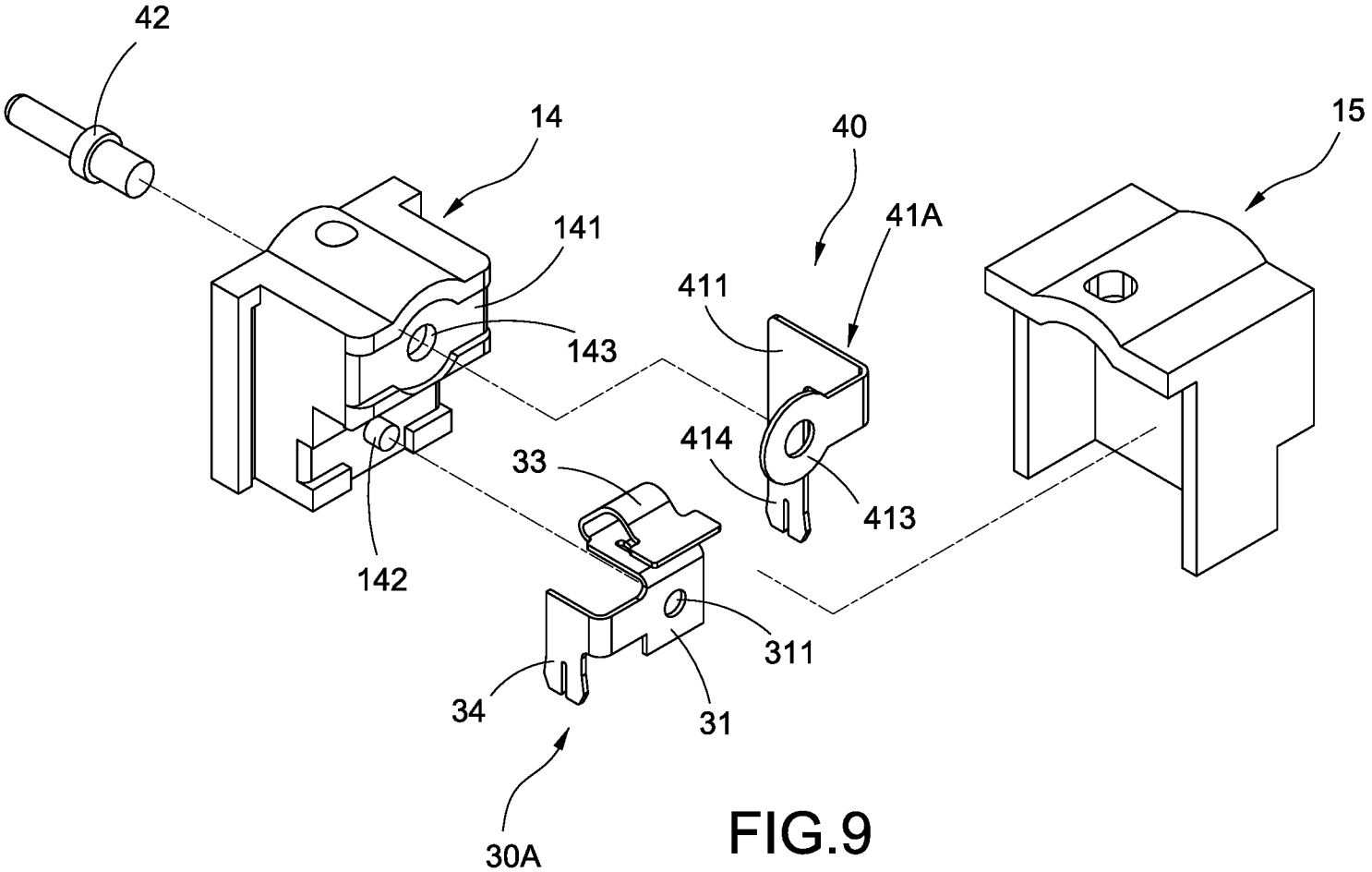
FIG. 9 is an exploded view of a female terminal seat assembly and each conductively connected component.
Figure 10:
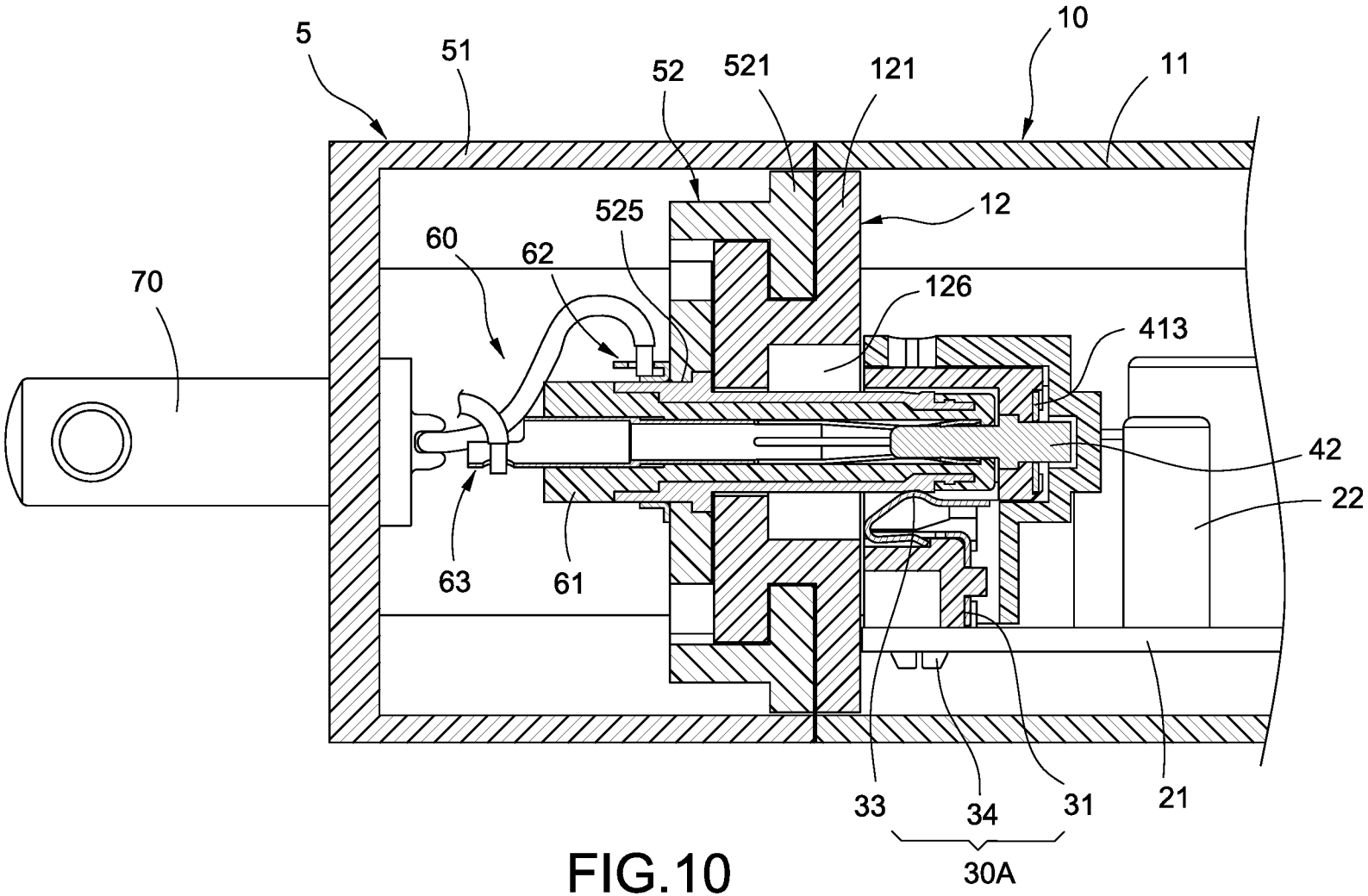
FIG. 10 is a cross-sectional view of a second embodiment of the present disclosure.

With reference to FIGS. 7 to 10 for an interchangeable plug charger with a coaxial conductive structure in accordance with another embodiment of the present disclosure, this embodiment is substantially the same as the previous embodiment, except that this embodiment further comprises a terminal female seat assembly 13 installed in the cylinder 11 and formed on a side of the side cover 12, and the terminal female seat assembly 13 comprises a female terminal block 14 and an insulating cover 15, and the female terminal block 14 has a terminal fixing table 141 and a positioning column 142. In addition, a through hole 143 is formed at the center of the terminal fixing table 141, and a terminal receiving slot 144 (as shown in FIG. 8) is formed between the back of terminal fixing table 141 and the positioning column 142, and the terminal receiving slot 144 is formed at the top of the positioning column 142.

The first conductive terminal 30A comprises a fixed section 31, a conductively connecting section 33 extending outwardly from the fixed section 31, and a plugging section 34 extending from the fixed section 31 in a direction away from the conductively connecting section 33, wherein the fixed section 31 has a positioning hole 311, and the first conductive terminal 30A is sheathed on the positioning column 142 through the positioning hole 311, and the conductively connecting section 33 is passed through the terminal receiving slot 144 and fixed to the female terminal block 14. The circuit board 21 of the power supply module 20 has two terminal plug slots 211 formed thereon, and the plugging section 34 is plugged into one of the terminal plug slots 211 and then welded with the terminal plug slot 211 to achieve an electrical connection.

The second conductive terminal 40 comprises a conductive terminal 41A and a conductive column 42, and the conductive terminal 41A comprises a fixed section 411, a conductively connecting section 413 extending outwardly from the fixed section 411, and a plugging section 414 extending from the fixed section 411 in a direction away from the conductively connecting section 413, wherein the conductive column 42 has an end passed through the through hole 143 and connected to the conductively connecting section 413 and the other end formed in the terminal receiving slot 144, and the plugging section 414 is plugged into the other terminal plug slot 211 and then welded with the other terminal plug slot 211 to achieve an electrical connection.

The insulating cover 15 is covered onto the female terminal block 14 to protect the first conductive terminal 30A and the second conductive terminal 40 of the conductive terminal 41A, so as to prevent the arcing of voltage and current and improve the safety of use.

In summation of the description above, this disclosure surely can achieve the expected objectives and overcome the drawbacks of the prior art, and it also complies with patent application requirements, and thus is duly filed for patent application. While this disclosure has been described by means of specific embodiments, numerous modifications and variations could be made thereto by those skilled in the art without departing from the scope and spirit of this disclosure set forth in the claims.

What is claimed is:

1. An interchangeable plug charger with a coaxial conductive structure, comprising: a charger body, having a retaining surface, and a first conductive terminal and a second conductive terminal disposed on the retaining surface; and a plug assembly, detachably coupled to the charger body, and comprising a plug socket and a coaxial conductive structure passing and coupling to the plug socket, and the coaxial conductive structure comprising a hollow insulating column, sheathed on a first conductively connected component outside the hollow insulating column and passed and coupled to a second conductively connected component inside the hollow insulating column, and the first conductively connected component being electrically coupled to the first conductive terminal, and the second conductively connected component being electrically coupled to the second conductive terminal, wherein the first conductively connected component comprises an outer copper bushing and a conductive ring, and the outer copper bushing is sheathed on the hollow insulating column, and the conductive ring is sheathed on the outer copper bushing, wherein the plug socket comprises an end cover, and the end cover comprises a cover plate and a boss extending outwardly from the cover plate, and the boss has a shaft hole and a plurality of positioning notches formed at the outer periphery of the shaft hole, and the coaxial conductive structure is passed and coupled into the shaft hole, and the conductive ring has a positioning plate embedded into each respective positioning notch.

2. The interchangeable plug charger with a coaxial conductive structure as claimed in claim 1, wherein the charger body comprises a casing, and the casing comprises a side cover, and the side cover comprises a base plate, a boss extending outwardly from the base plate, and a pair of hooks formed at an end of the boss away from the base plate, and the plug assembly comprises a plug socket, and the plug socket comprises an end cover, and the end cover comprises a cover plate, a boss extending outwardly from the cover plate, and a boss receiving slot formed at an end of the boss proximate to the cover plate, and the boss receiving slot has a pair of embedded slots, and the boss receiving slot is provided for embedding and installing the boss, and the embedded slot is provided for rotatably retaining each hook.

3. The interchangeable plug charger with a coaxial conductive structure as claimed in claim 1, wherein the first conductively connected component further comprises a conductively connected wire, and the plug assembly further comprises a pin, and the conductively connected wire has an end electrically coupled to the conductive ring and the other end electrically coupled to the pin.

4. The interchangeable plug charger with a coaxial conductive structure as claimed in claim 3, wherein the hollow insulating column has a terminal receiving hole, and the second conductively connected component comprises an inner copper bushing, and the inner copper bushing is passed and coupled into the terminal receiving hole, and the second conductive terminal comprises a conductive column, and the inner copper bushing is provided for passing and coupling to achieve an electrical connection.

5. The interchangeable plug charger with a coaxial conductive structure as claimed in claim 4, wherein the second conductively connected component further comprises a conductively connected wire, and the plug assembly further comprises another pin, and the conductively connected wire of the second conductively connected component has an end electrically coupled to the inner copper bushing and the other end electrically coupled to the other pin.

6. The interchangeable plug charger with a coaxial conductive structure as claimed in claim 1, wherein the charger body comprises a casing, and the casing comprises a cylinder and a side cover, and the cylinder has a closed end and an open end, and the side cover corresponding to the open end seals and covers the cylinder and forms the retaining surface.

7. The interchangeable plug charger with a coaxial conductive structure as claimed in claim 6, wherein the charger body further comprises a power supply module, and the power supply module is accommodated in the cylinder and comprises a circuit board, and the circuit board has a plurality of electronic components and a port, and the closed end of the cylinder has a slot opening, and the port is configured to be corresponsive to the slot opening.

8. The interchangeable plug charger with a coaxial conductive structure as claimed in claim 6, wherein the charger body further comprises a terminal female seat assembly installed in the cylinder and formed on a side of the side cover, and the terminal female seat assembly comprises a female terminal block and an insulating cover, and the first conductive terminal and the second conductive terminal are covered by the female terminal block and the insulating cover.

9. The interchangeable plug charger with a coaxial conductive structure as claimed in claim 8, wherein the charger body further comprises a power supply module, and the power supply module is accommodated in the cylinder and comprises a circuit board, and the circuit board has two terminal plug slots, and the first conductive terminal comprises a plugging section, and the second conductive terminal comprises a conductive terminal and a conductive column, and the conductive terminal comprises a plugging section, and each plugging section is plugged into each respective terminal plug slot.

10. The interchangeable plug charger with a coaxial conductive structure as claimed in claim 6, wherein the side cover comprises a base plate, a terminal fixing table and a positioning column extending from the base plate, and a terminal receiving slot is formed between the back of the terminal fixing table and the positioning column, and the first conductive terminal comprises a fixed section, an abutment section extending outwardly from the fixed section, and a conductively connecting section extending from the fixed section in a direction away from the abutment section, and the fixed section has a positioning hole, and the first conductive terminal is sheathed on the positioning column through the positioning hole and fixed by passing the conductively connecting section into the terminal receiving slot.

11. The interchangeable plug charger with a coaxial conductive structure as claimed in claim 10, wherein the second conductive terminal comprises a conductive terminal and a conductive column, and the conductive terminal comprises a fixed section, an abutment section extending outwardly from the fixed section, and a conductively connecting section extending from the fixed section in a direction away from the abutment section, and the fixed section of the second conductive terminal is attached onto a side of the terminal fixing table, and the conductively connecting section of the second conductive terminal is affixed onto the terminal fixing table, and the conductive column has an end passed and coupled to the conductively connecting section of the second conductive terminal and other end formed in the terminal receiving slot.

* * * * *